US008033131B2

(12) United States Patent
Yoon

(10) Patent No.: US 8,033,131 B2
(45) Date of Patent: Oct. 11, 2011

(54) EASILY-DRAINABLE DEHUMIDIFIER

(75) Inventor: Hee-Jong Yoon, Kyunggi-do (KR)

(73) Assignee: Winix Inc. (KR)

( * ) Notice: Subject to any disclaimer, the term of this patent is extended or adjusted under 35 U.S.C. 154(b) by 66 days.

(21) Appl. No.: 12/546,373

(22) Filed: Aug. 24, 2009

(65) Prior Publication Data

US 2010/0071399 A1 Mar. 25, 2010

Related U.S. Application Data

(63) Continuation of application No. PCT/KR2008/005750, filed on Sep. 30, 2008.

(30) Foreign Application Priority Data

Sep. 22, 2008 (KR) ..... 10-2008-0092720

(51) Int. Cl.
*F25D 21/14* (2006.01)

(52) U.S. Cl. ..... 62/291

(58) Field of Classification Search ..... 62/291, 62/272, 285, 389
See application file for complete search history.

(56) References Cited

FOREIGN PATENT DOCUMENTS

| | | | |
|---|---|---|---|
| JP | 9-269140 | A | 10/1997 |
| KR | 0127728 | Y1 | 12/1998 |
| KR | 10-2004-0029623 | A | 4/2004 |

OTHER PUBLICATIONS

"International Application Serial No. PCT/KR2008/005750, International Search Report mailed Mar. 31, 2009", 3 pgs.
"International Application Serial No. PCT/KR2008/005750, Written Opinion mailed Mar. 31, 2009", 4 pgs.

*Primary Examiner* — Melvin Jones
(74) *Attorney, Agent, or Firm* — Schwegman, Lundberg & Woessner, P.A.

(57) ABSTRACT

Various embodiments include an easily-drainable dehumidifier designed to automatically or manually drain water stored in a water tank in accordance with a user selection. In various embodiments, the easily-drainable dehumidifier includes a case defining an exterior of the dehumidifier and provided with an air inlet and outlet, a dehumidifying unit that is installed in the case to remove moisture from air introduced into the case through the air inlet and discharge the air to an external side through the air outlet, a water tank that stores water generated by dehumidification of the dehumidifying unit and that is provided at a side with a first connecting portion having a first water outlet, a connecting member having a second connecting portion that is detachably connected to the first connecting portion of the water tank and provided with a second water outlet that selectively communicates with the first water outlet.

8 Claims, 4 Drawing Sheets

EASILY-DRAINABLE DEHUMIDIFIER

CROSS REFERENCE TO RELATED APPLICATION

This application is a continuation under 35 U.S.C. 111(a) of PCT/KR2008/005750, filed Sep. 30, 2008, which application claims priority to and the benefit of Korean Patent Application No. 10-2008-0092720, filed Sep. 22, 2008, which applications are incorporated herein by reference and made a part hereof.

TECHNICAL FIELD

The present invention relates to an easily-drainable dehumidifier. More particularly, the present invention relates to an easily-drainable dehumidifier that is designed to automatically or manually drain water stored in a water tank in accordance with a user selection.

BACKGROUND ART

Generally, a typical dehumidifier is an appliance for removing moisture from indoor air. There are various dehumidifiers using different dehumidifying methods.

Among the dehumidifiers, a cooling-type dehumidifier using a cooling cycle in which moisture is removed from the air by condensing the moisture contained in the air when the air passes through a vaporizer.

The dehumidifier includes a case defining an appearance of the dehumidifier and provided with an air inlet, an intake fan that is installed in the case to suck external air, a dehumidifying unit that removes moisture from the air sucked by the intake fan by condensing the moisture contained in the air, and a water tank for storing the water generated by the dehumidification of the dehumidifying unit.

The dehumidifying unit includes a compressor for compressing a gaseous refrigerant into a high temperature/pressure state, a condenser for condensing the high temperature/pressure gaseous refrigerant, and a vaporizer for vaporizing the refrigerant that is reduced in pressure while passing through an expansion tube via the condenser.

The refrigerant circulates through the humidifier. That is, the refrigerant is directed to the vaporizer through the compressor and returned to the vaporizer via the condenser and expansion tube.

At this point, when the air is sucked into the case by the rotation of the fan, the sucked air is cooled down to or below the dew point while passing through the vaporizer and condensed. Therefore, the moisture contained in the air is removed by being changed into dewdrops.

The dewdrops are directed into the water tank and stored as water. Therefore, the water filled in the tank should be drained to an external side after a predetermined time has passed.

In order to drain the water filled in the water tank, the water tank installed in the humidifier is separated from the case and the user empties the water tank by himself/herself. Alternatively, a drain pump installed outside or inside the dehumidifier may be used to discharge the water out of the water tank.

The above-described water discharging methods are a manual discharging method where the user empties the water tank by himself/herself and an automatic discharging method using the drain pump. Therefore, when the manual discharging method is used, the user may feel inconvenience in use. When the automatic discharging method is used, the user may face restriction on a using place of the humidifier.

That is, when the humidifier employing the manual discharging method is used, the user must periodically empty the water tank. This is troublesome for the user. When the humidifier employing the automatic discharging method, a discharge pipeline must be installed and thus the user may face the restriction on the using place of the humidifier.

The above information disclosed in this Background section is only for enhancement of understanding of the background of the invention and therefore it may contain information that does not form the prior art that is already known in this country to a person of ordinary skill in the art.

DETAILED DESCRIPTION

Technical Problem

The present invention has been made in an effort to provide an easily-drainable dehumidifier having an advantage of automatically or manually draining water stored in a water tank in accordance with a user selection.

Technical Solution

According to an exemplary embodiment of the present invention, an easily-drainable dehumidifier includes a case defining an exterior of the dehumidifier and provided with an air inlet and outlet, a dehumidifying unit that is installed in the case to remove moisture from air introduced into the case through the air inlet and discharge the air to an external side through the air outlet, a water tank that stores water generated by dehumidification of the dehumidifying unit and is provided at a side with a first connecting portion having a first water outlet, a connecting member having a second connecting portion that is detachably connected to the first connecting portion of the water tank and provided with a second water outlet that selectively communicates with the first water outlet, and a drain pump that is connected to the connecting member to drain the water stored in the water tank to an external side.

When the water tank is connected to the connecting member, the water stored in the water tank is directed to the connecting member. When the water tank is separated from the connecting member, the water stored in the water tank is not discharged out of the water tank.

Advantageous Effects

According to the easily-drainable dehumidifier of the exemplary embodiment of the present invention, the water stored in the water tank can be automatically drained by the drain pump or manually drained by the user who separates the water tank from the dehumidifier and empties the water tank. Therefore, the humidifier can be used anywhere without being restricted by place.

In addition, since the water stored in the water tank can be automatically or manually discharged in accordance with the user's selection, it is convenient to use the dehumidifier.

BEST MODE

An exemplary embodiment of the present invention will hereinafter be described in detail with reference to the accompanying drawings.

Figure 1:
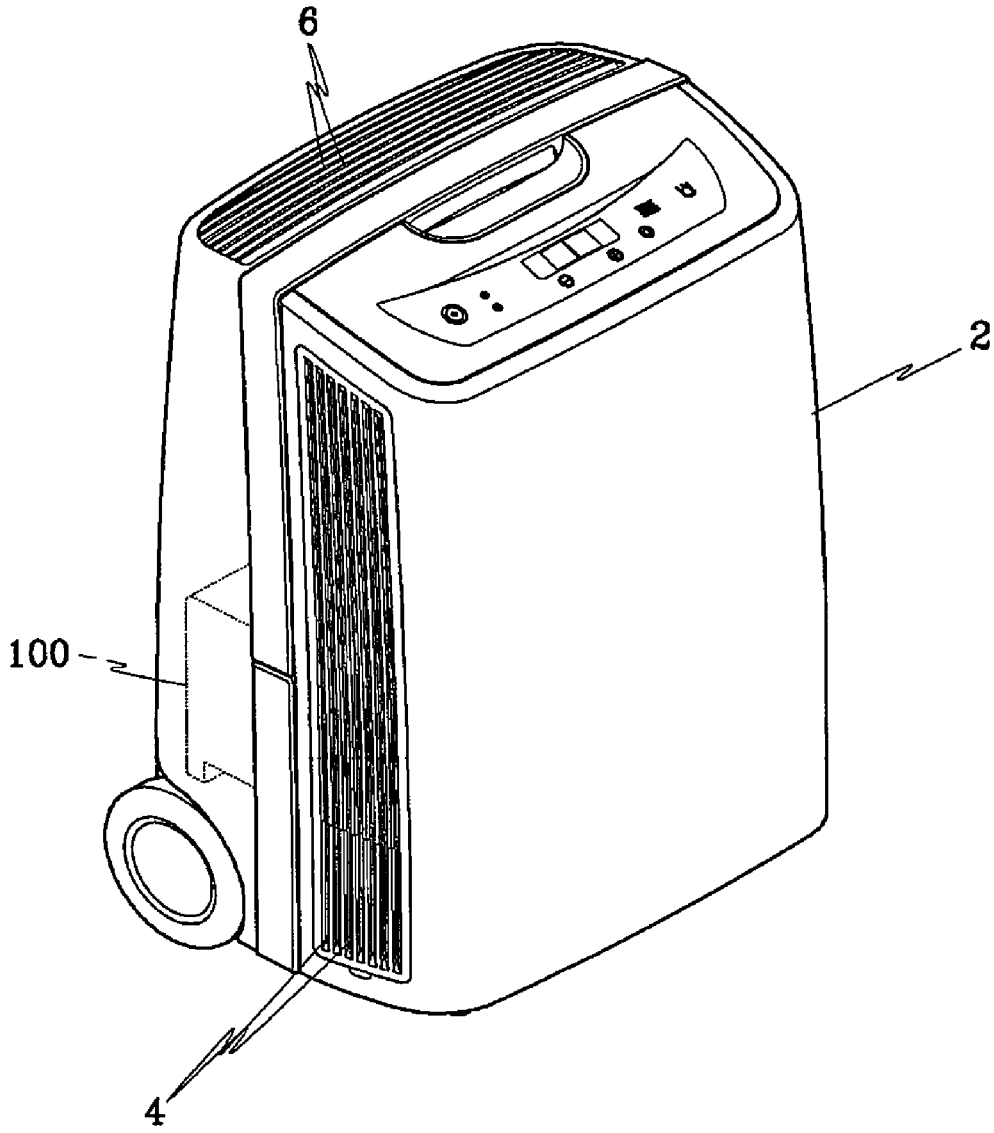
FIG. 1 is a perspective view of an easily-drainable dehumidifier according to an exemplary embodiment of the present invention.
Figure 2:
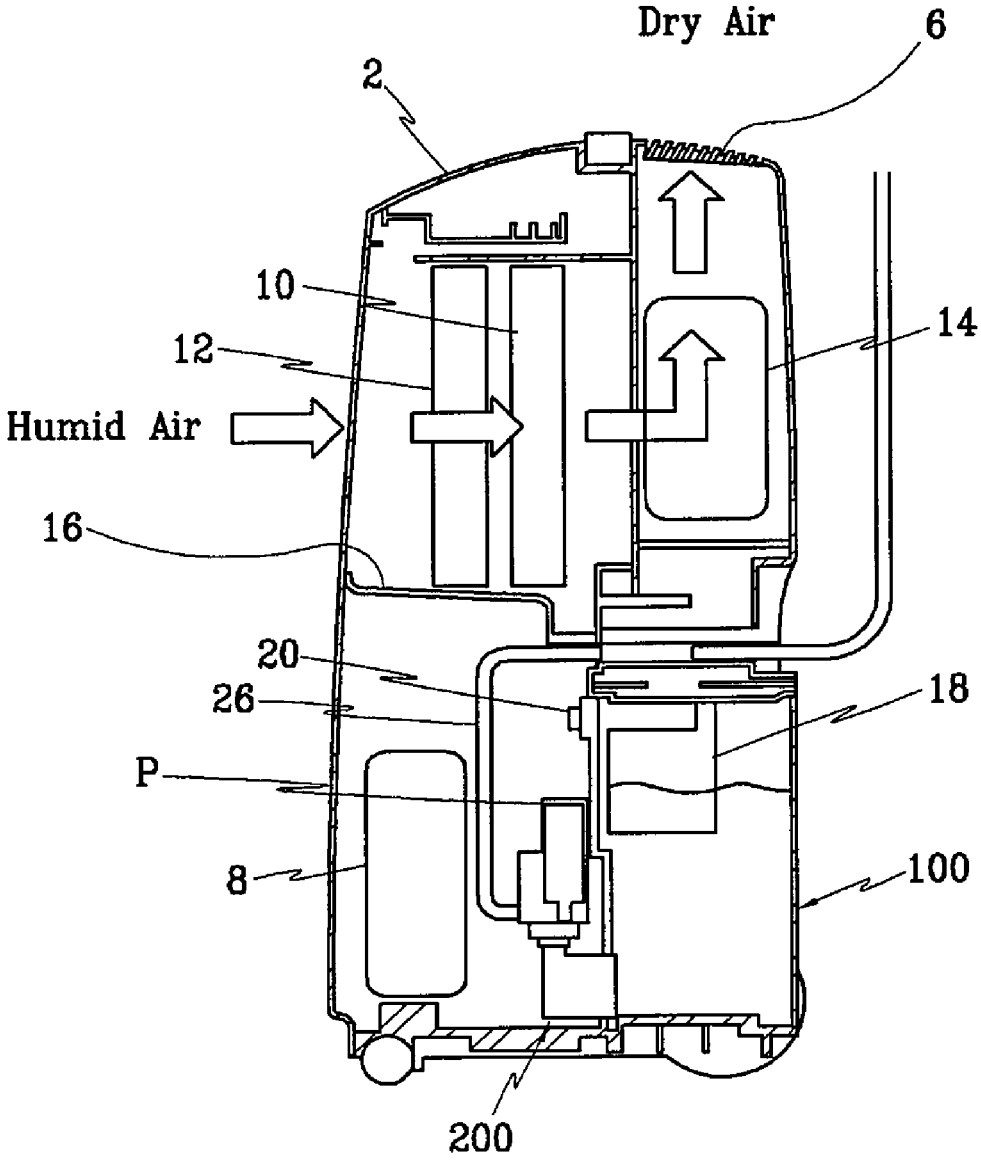
FIG. 2 is a cross-sectional view of FIG. 1.
Figure 3:
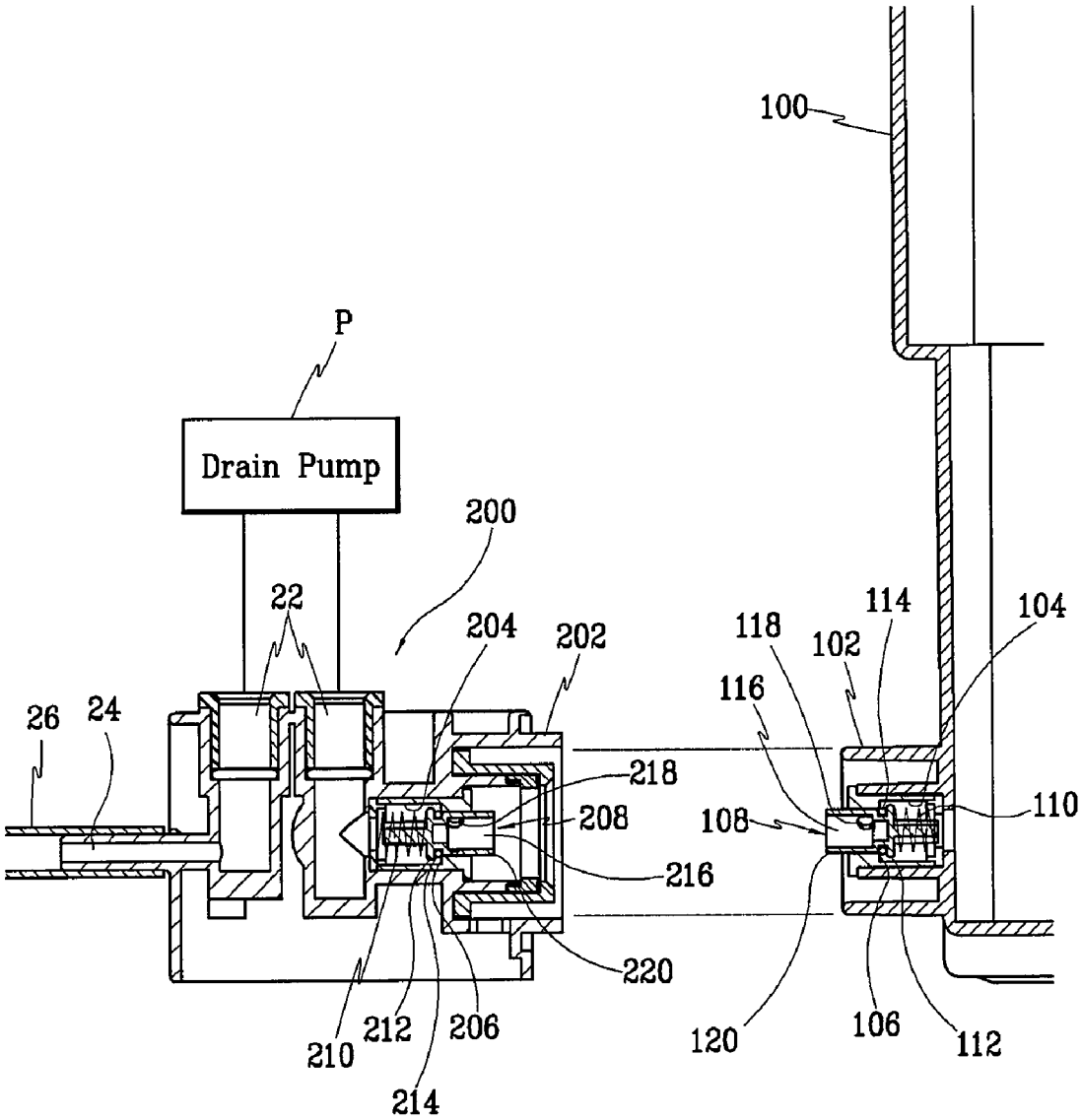
FIG. 3 is an enlarged sectional view of the easily-drainable dehumidifier of FIG. 1, illustrating a state where a water tank is separated from a connecting member.
Figure 4:
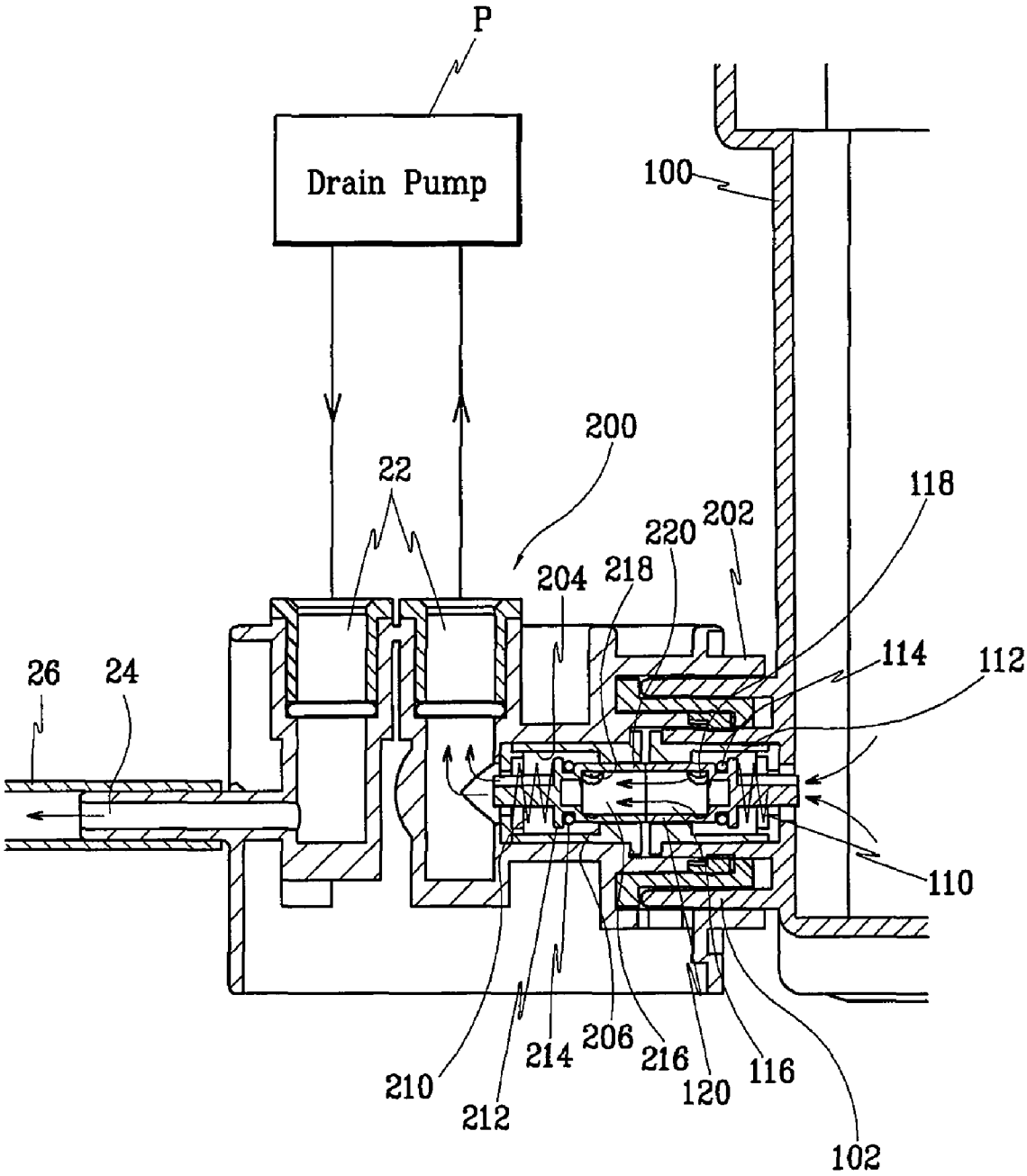
FIG. 4 is an enlarged sectional view of the easily-drainable dehumidifier of FIG. 1, illustrating a state where a water tank is connected to the connecting member.

FIG. 1 is a perspective view of an easily-drainable dehumidifier according to an exemplary embodiment of the present invention, FIG. 2 is a cross-sectional view of FIG. 1, and FIGS. 3 and 4 are enlarged sectional views of the easily-drainable dehumidifier of FIG. 1, illustrating a connecting state structure of a water tank and a connecting member.

A dehumidifier of an exemplary embodiment of the present invention includes a case 2 defining an exterior shape of the dehumidifier, a dehumidifying unit that is installed in the case to suck air and remove moisture from the air, and a water tank 100 for storing water generated by the dehumidifying unit therein.

The case 2 is provided at the front or front and side surfaces thereof with an air inlet 4 through which the air is introduced into the dehumidifying unit. The case 2 is provided at the top surface or top and rear surfaces with an air outlet 6 through which the air from which the moisture is removed by the dehumidifying unit is discharged to an external side.

The dehumidifying unit may be a cooling system including a compressor 8 for compressing a gaseous refrigerant into a high temperature/pressure state, a condenser 10 for condensing the high temperature/pressure gaseous refrigerant, and a vaporizer 12 for vaporizing the refrigerant that is reduced in pressure while passing through an expansion tube via the condenser. A fan 14 for sucking the air to the dehumidifying unit is installed behind the condenser 10.

A water pan 16 for collecting the water that is generated as the air passes through the vaporizer 12 and the moisture contained in the air changes into dewdrops is further provided. The water tank 100 is disposed under the water pan 16 so that the water collected in the water pan 16 is directed to and stored in the water tank 100.

A float 18 that varies in height in accordance with the water level of the water tank 100 is installed in the water tank 100. A micro-switch 20 that is turned on when the float 18 ascends to a predetermined height and is turned off when a predetermined time has passed after turning on is also installed in the water tank 100.

A drain pump P is provided to drain the water stored in the water tank 100. The water tank 100 is connected to the drain pump P by a connecting member 200.

The dehumidifier in accordance with the exemplary embodiment of the present invention is designed such that a user drains the water stored in the water tank 100 by himself/herself or the drain pump P driven by the micro-switch 20 can drain the water stored in the water tank 100.

To this end, the water tank 100 and the connecting member 200 respectively have connecting portions 102 and 202 that enable the water tank 100 and the connecting member 200 to be detachably connected to each other. The connecting member 200 is fixed to the inside of the dehumidifier by a fixing member (not shown). The water tank 100 is detachably connected to the connecting member 200.

The connecting portions 102 and 202 are correspondingly shaped so that they are closely inserted to one another.

The connecting portions 102 and 202 are respectively provided inside thereof with water outlets 104 and 204. Opening/closing members are provided on the respective water outlets 14 and 204 to selectively open the water outlets 104 and 204. Each of the opening/closing members is designed to selectively open or close the corresponding water outlet 104 or 204 when the water tank 100 is connected to or separated from the connecting member 200.

The water outlets 104 and 204 are respectively provided at inner circumferences thereof with hook steps 106 and 206 to maintain an installing state of the opening/closing member and restrict an operational range of the opening/closing member.

The first opening/closing member formed on the connecting portion 102 of the water tank 100 includes a first valve 108 that is installed to be capable of linearly moving inside the water outlet 104 to open and close the water outlet 104, and an elastic member 110 that maintains a closed state of the water outlet 104 by biasing the first valve 108.

The first valve 108 is formed of a supporting plate 112 having a central portion extending to an outer circumference. The elastic member 110 is supported on one side of the supporting plate 112. An O-ring 114 is fitted on the other side of the supporting plate 112 to maintain sealing force when the first valve 108 is in a closed position.

The first valve 108 has a first portion located at an outer side of the water outlet 104. The first portion is a hollow area 116 and is provided with a plurality of through holes 118. Therefore, when the first valve 108 is in the opening position, the water is discharged through the through holes 118.

The first valve 108 has an outer end that functions as a contacting surface 120. The contacting surface 120 functions to move the first valve 108 to the opening position when the connecting portion 102 of the water tank 100 is connected to the connecting portion 202 of the connecting member 200.

When the connecting portions 102 and 202 are not interconnected, the first valve 108 structured as described above closes the water outlet 104 as the hook step 106 of the water outlet 104 surface-contacts the O-ring 114 by the outward biasing force of the elastic member 110 as shown in FIG. 3.

Meanwhile, a second opening/closing member having an identical structure to the first opening/closing member is provided on the connecting portion 202 of the connecting member 200.

That is, the second opening/closing member provided on the connecting portion 102 of the connecting member 200 includes a second valve 208 that is installed to be capable of linearly moving inside the water outlet 204 to open and close the water outlet 204, and an elastic member 210 that maintain a closed state of the water outlet 204 by biasing the second valve 208.

The second valve 208 is formed of a supporting plate 212 having a central portion extending to an outer circumference. The elastic member 210 is supported on one side of the supporting plate 212. An O-ring 214 is fitted on the other side of the supporting plate 212 to maintain sealing force when the second valve 208 is in a closed position.

The second valve 208 has a first portion located at an outer side of the water outlet 204. The first portion is a hollow area 216 and is provided with a plurality of through holes 218. Therefore, when the second valve 208 is in the opening position, the water is discharged through the through holes 218.

The second valve 208 has an outer end that functions as a contacting surface 220. The contacting surface 220 functions to move the second valve 208 to the opening position when the connecting portion 102 of the water tank 100 is connected to the connecting portion 202 of the connecting member 200.

When the connecting portions 102 and 202 are not interconnected, the second valve 208 structured as described above closes the water outlet 204 as the hook step 206 of the water outlet 204 surface-contacts the O-ring 214 by the outward biasing force of the elastic member 210, as shown in FIG. 3.

The first and second valves 108 and 208 move to their opening positions to allow the water stored in the water tank 100 to be discharged through the water outlets 104 and 204 as the contacting surfaces 120 and 220 respectively compress the elastic members 110 and 210.

When the connecting portions 102 and 202 are separated from each other, the contacting surfaces 120 and 220 surface-contacting each other are separated from each other and thus the first and second valves 108 and 208 move to their closing positions by the restoring outward elastic force of the elastic members 110 and 210.

In order for the water outlet 104 of the water tank 100 to be closed prior to the water outlet 204 of the connecting member 200 when separating the connecting portions 102 and 202 from each other, the elastic force of the elastic member 110 for the first valve 108 is greater than that of the elastic member 210 for the second valve 208.

Therefore, when the water tank 100 is separated from the connecting member 200, the water outlet 104 of the water tank 100 is first closed, after which the water outlet 204 of the connecting member 200 is closed, thereby preventing the water stored in the water tank 100 from leaking.

The above-described easily-drainable dehumidifier can be installed in a desired place where dehumidification is require. When the dehumidifier is turned on, the fan 14 is driven and thus the external air is introduced into the dehumidifier through the air inlet 4. The introduced air is discharged through the air outlet 6 as the moisture is removed from the air by the dehumidifying unit.

At this point, the introduced air is cooled below the dew point by the refrigerant as it passes through the vaporizer 12, in the course of which the moisture contained in the air changes into dewdrops that are collected in the water pan 16 and flow to the water tank 100.

The water stored in the water tank 100 may be automatically or manually discharged to the external side.

That is, when a predetermined amount of the water 100 is stored in the water tank 100, the float 18 ascends to contact the micro-switch 20. Then, the drain pump P is driven while being connected to the connecting member 200 via an assembling member 22.

As the drain pump P is driven, the water stored in the water tank 100 is directed to the water outlet 104 and discharged through the water outlet 204 through the through holes 118 and 218, after which the water is discharged through a water outlet 24 through the drain pump P. A drain pipe 26 is connected to the water outlet 24 to direct the water to the external side.

As the water stored in the water tank 100 is discharged, the float descends. In this state, the drain pump P is driven for a predetermined time to further discharge the water stored in the water tank 100. In addition, after a predetermined time has passed, the micro-switch 20 operates to cut off the power applied to the drain pump P and thus stop the drain pump P.

When the drain pump P stops operating, the discharge of the water stored in the water tank 100 is stopped. When the water is again filled in the water tank 100 to a predetermined water level, the float 18 ascends to contact the micro-switch 20. Then, the water stored in the water tank 100 is discharged by the operation of the drain pump P.

It is possible to change the discharge method to manual discharge while automatically discharging the water stored in the water tank as described above. To this end, the connecting portion 102 of the water tank 100 is separated from the connecting portion 202 of the connecting member 200 as shown in FIG. 3.

As described above, the elastic force of the elastic member 110 provided on the first valve 108 for the water tank 100 is greater than that of the elastic member 210 provided on the second valve 208 for the connecting member 200. Therefore, when separating the connecting portions 102 and 202 from each other, the water outlet 104 of the water tank 100 is first closed, after which the water outlet 204 of the connecting member 200 is closed.

The closed state of the first valve 108 is maintained by separating the water tank 100 from the connecting member 200 as described above. In this state, the water tank 200 is separated from the dehumidifier and emptied by the user.

The emptied water tank 100 is installed in the dehumidifier as shown in FIG. 4.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An easily-drainable dehumidifier comprising:

a case defining an exterior of the dehumidifier and provided with an air inlet and outlet;

a dehumidifying unit that is installed in the case to remove moisture from air introduced into the case through the air inlet and discharge the air to an external side through the air outlet;

a water tank that stores water generated by dehumidification of the dehumidifying unit and that is provided at a side with a first connecting portion having a first water outlet;

a connecting member having a second connecting portion that is detachably connected to the first connecting portion of the water tank and provided with a second water outlet that selectively communicates with the first water outlet; and a drain pump that is connected to the connecting member to drain the water stored in the water tank to an external side, wherein the first and second water outlets are respectively provided with first and second opening/closing members for selectively opening and closing the respective first and second water outlets.

2. The easily-drainable dehumidifier of claim 1, wherein the first and second opening/closing members are designed to direct the water stored in the water tank to the connecting member by opening the first and second water outlets when the first and second connecting portions are connected to each other.

3. The easily-drainable dehumidifier of claim 1, wherein the first and second opening/closing members are designed to close the first and second water outlets when the first and second connecting portions are separated from each other.

4. The easily-drainable dehumidifier of claim 1, wherein, when the first and second connecting portions are separated from each other, the first opening/closing member is first closed and then the second opening/closing member is closed.

5. The easily-drainable dehumidifier of claim 1, wherein the first opening/closing member comprises:

a first valve that is installed to be capable of linearly moving inside the first water outlet to open and close the first water outlet, and a first elastic member that maintains a closed state of the second water outlet by biasing the first valve; and the second opening/closing member comprises a second valve that is installed to be capable of linearly moving inside the second water outlet to open and close the second water outlet, and a second elastic member that maintains a closed state of the second water outlet by biasing the second valve.

6. The easily-drainable dehumidifier of claim 5, wherein the first elastic member has greater elastic force than the second elastic member.

7. The easily-drainable dehumidifier of claim 1, wherein a float of which location varies in accordance with a water level of the water tank is installed in the water tank, and the drain pump is driven for a predetermined time to drain the water stored in the water tank when the float ascends to a predetermined height to contact a micro-switch.

8. The easily-drainable dehumidifier of claim 1, wherein the connecting member is provided with a third water outlet through which the water is discharged by the drain pump and a drain pipe along which the water is directed out of the dehumidifier is connected to the third water outlet.

* * * * *